US005372884A

United States Patent [19]

Abe et al.

[11] Patent Number: 5,372,884

[45] Date of Patent: Dec. 13, 1994

[54] INK JET RECORDING SHEET

[75] Inventors: Yasumine Abe; Touru Noda, both of Tokyo, Japan

[73] Assignee: Mitsubishi Paper Mills Limited, Tokyo, Japan

[21] Appl. No.: 94,517

[22] Filed: Jul. 19, 1993

[30] Foreign Application Priority Data

Sep. 9, 1992 [JP] Japan ..... 4-240725

[51] Int. Cl.[5] ..... B41M 5/00

[52] U.S. Cl. ..... 428/331; 428/195; 428/341; 428/342; 428/403; 428/404; 428/480; 428/513

[58] Field of Search ..... 503/227; 428/195, 211, 428/327, 331, 520, 913, 914, 341, 342, 403, 404, 480, 513

[56] References Cited

U.S. PATENT DOCUMENTS 5,104,730 4/1992 Misuda et al. ..... 428/304.4
5,198,408 3/1993 Martin ..... 503/227

FOREIGN PATENT DOCUMENTS 60-219084 11/1985 Japan .
60-232990 11/1985 Japan .
3-281383 12/1991 Japan .
5-51469 3/1993 Japan .

OTHER PUBLICATIONS

Patent Abstracts of Japan, vol. 10, No. 77 (M-464) (2134), 26 Mar. 1986 (JP-A-60 219 083-Abstract).
Patent Astracts of Japan, vol. 10, No. 77 (M-464) (2134), 26 Mar. 1986 (JP-A-60 219 084-Abstract.

*Primary Examiner*—Pamela R. Schwartz
*Attorney, Agent, or Firm*—Armstrong, Westerman, Hattori, McLeland & Naughton

[57] ABSTRACT

Disclosed is an ink jet recording sheet comprising a support and an ink receiving layer provided on at least one side of the support wherein said ink receiving layer contains a cation-modified non-spherical colloidal silica. The cation-modifier used is preferably hydrous aluminum oxide, hydrous zirconium oxide or hydrous tin oxide. The ink jet recording sheet is high in gloss, quick in drying of ink and superior in water resistance of ink jet recorded images and film formability of the ink receiving layer.

6 Claims, No Drawings

INK JET RECORDING SHEET

BACKGROUND OF THE INVENTION

The present invention relates to an ink jet recording sheet which uses mainly an aqueous ink and particularly to an ink jet recording sheet which is excellent in drying properties and in water resistance of images and further, high in gloss.

Since ink jet recording produces little noise and makes high-speed printing possible, ink jet recording has now become widespread rapidly. Color recording can be performed relatively easily by using two or more ink nozzles, and a variety of color ink jet recording systems have been developed. Recently, use of ink jet printers as a means of obtaining computer hard copies, that has enabled quick and accurate formation of computer-drawn images consisting of graphics and fonts, is attracting attention. Such computer-drawn and ink-jet printed hard copies are not limited to paper sheets, but also transparencies for overhead projectors (hereinafter referred to as "OHP") that are quite commonly used nowadays in presentations. Moreover, a particularly noticeable field of use nowadays of the computer-drawn and ink jet printed hard copy is a color proof in printing industry or a proof output of designs where a photographic quality color image development is required.

As inks for ink jet recording, those which are mainly composed of aqueous solution of a polyhydric alcohol are used from the points of safety, desired recording characteristics and inhibition of clogging. Improvements of these characteristics are still being on the way.

As the recording sheet for ink jet recording, there have been generally used an ordinary non-coated paper or special sheet comprising a support and a porous ink-absorbing layer provided thereon which is called ink jet recording sheet.

However, there are certain serious problems when the conventional ink jet recording sheets are used for a color proof or design proof in which high gloss and quick drying properties are required. That is, when the conventional ink jet recording sheet comprising a support and a porous ink-absorbing layer provided on the support is printed by an ink jet printer, the gloss decreases owing to the light scattering by the porous ink-absorbing layer and such sheet cannot be practically used. Further, when the conventional ink-absorbing layer is used for OHP, the porous ink-absorbing layer causes reduction of the light transmission even when a transparent support is used.

When the surface of the ink-absorbing layer is nonporous, the light transmission can be improved, but since it is inferior in aqueous ink receptivity, the ink remains wet for a long time on the surface of the sheet after the image has been recorded and a long time is required for fixing or drying the recorded images. Furthermore, the known ink jet recording sheets lack water resistance of the images printed thereon and cannot be employed for such use as requiring water resistance.

In order to solve these problems, various recording sheets having a transparent ink-absorbing layer high in ink receptivity have been proposed. For example, there are proposed use of polyvinyl alcohol and polyacrylic acid-based water-soluble polymers in Japanese Patent Kokai (Laid-Open) No. 60-168651, use of hydroxyethyl cellulose in Japanese Patent Kokai (Laid-Open) No. 60-262685, use of a mixture of carboxymethyl cellulose and polyethylene oxide in Japanese Patent Kokai (Laid-Open) No. 61-181679, use of a mixture of a water-soluble cellulose and polyvinyl pyrrolidone in Japanese Patent Kokai (Laid-Open) No. 61-193879, use of a receiving layer formed of an aqueous gelatin solution of a specific pH in Japanese Patent Kokai (Laid-Open) No. 62-263084, and use of a mixture of gelatin and a surfactant in Japanese Patent Kokai (Laid-Open) No. 1-146784.

The recording sheets disclosed in these patent publications are superior in light transmission. However, even these recording sheets cannot satisfactorily attain the quick drying properties of the ink and high gloss of the sheets together and cannot be used for color proofs or design proofs.

SUMMARY OF THE INVENTION

A first object of the present invention is to provide an ink jet recording sheet quick in drying of ink and very high in gloss.

A second object of the present invention is to provide an ink jet recording sheet suitable for OHP and excellent in light transmission.

A third object of the present invention is to provide an ink jet recording sheet whose ink-receiving layer is excellent in water resistance and film-formability, so that the layer stands wetting and gives little cracks.

As a result of intensive research conducted by the inventors, it has been found that the above objects can be attained by an ink jet recording sheet comprising a support having an ink-receiving layer on at least one side, characterized in that said ink-receiving layer contains a cation-modified non-spherical colloidal silica.

As mentioned above, the ink jet recording sheet of the present invention comprises a support and, provided on at least one side thereof, an ink-receiving layer containing a cation-modified non-spherical colloidal silica.

DESCRIPTION OF THE INVENTION

The cation-modified non-spherical colloidal silica used in the present invention is a non-spherical colloidal silica which is cation-modified by coating the surface thereof with a hydrous metal oxide. The term "non-spherical" used herein means "substantially not spherical", and preferred is one acicular or fibrous in shape. As for the size, preferred is from several μm to about 500 μm along longitudinal direction.

As the cation-modified non-spherical colloidal silica used in the present invention, preferred is a non-spherical colloidal silica which is cation-modified by coating with a hydrous metal oxide such as hydrous aluminum oxide, hydrous zirconium oxide, hydrous tin oxide or the like and especially preferred is one which is cation-modified with hydrous aluminum oxide. The cation-modification can be carried out by the methods as described, for example, in U.S. Pat. No. 3,007,878 and Japanese Patent Kokoku No. 47-26959.

The coating amount of the cation-modifier, hydrous metal oxide, in the cation-modified non-spherical colloidal silica is suitably in the range of 1 to 30% by weight (in terms of the anhydrous metal oxide) based on silica (in terms of $SiO_2$). If the coating amount of the cation-modifier is too small, water resistance of the ink recorded image on the recording sheet is considerably deteriorated and gloss is lowered. If it is too large, the ink-receiving layer is brittle and cracks occur and besides the gloss tends to decrease. Thus, the coating amount is preferably 2.5 to 25% by weight, especially preferably 5 to 20% by weight. Furthermore, the cation-modified non-spherical colloidal silica suspension may contain acid components such as acetic acid, citric acid, sulfuric acid and phosphoric acid for colloid stabilization and other purposes. Examples of the cation-modified non-spherical colloidal silica include "ST-specially modified series" manufactured by Nissan Chemical Industries, Ltd.

The coating amount of the cation-modified non-spherical colloidal silica contained in the ink-receiving layer is suitably in the range of 2 to 100 g/m$^2$ as solid content. If the coating amount is too small, ink receptivity is inferior, drying property of the ink recorded image deteriorates and sharpness of the image decreases. If it is too large, the ink receiving layer is brittle to cause cracks and furthermore, gloss and transparency tend to deteriorate and the sheet obtained tends to curl. Thus, the coating amount is preferably 4 to 50 g/m$^2$, especially preferably 6 to 30 g/m$^2$.

The ink-receiving layer of the present invention may contain various polymers for improving the drying property of the ink, the film-forming properties of the ink-receiving layer, the gloss and the sharpness of the image. Examples of the polymers are various gelatins such as lime-treated gelatin, acid-treated gelatin, enzyme-treated gelatin, gelatin derivatives and reaction products of gelatins with anhydrides of dibasic organic acids such as phthalic acid, maleic acid and fumaric acid; non-modified polyvinyl alcohols of various saponification degrees, carboxy-modified, cation-modified and amphoteric polyvinyl alcohols and derivatives thereof; starches such as oxidized starch, cationized starch and etherified starch; cellulose derivatives such as carboxymethyl cellulose and hydroxyethyl cellulose; synthetic polymers such as polyvinyl pyrrolidone, polyvinylpyridium halide, sodium polyacrylate, salts of acrylic acid-methacrylic acid copolymer, polyethylene glycol, polypropylene glycol, polyvinyl ether, alkylvinyl ether-maleic anhydride copolymers, styrene-maleic anhydride copolymer and salts thereof and polyethyleneimine; conjugated diene copolymer latexes such as styrene-butadiene copolymer and methyl methacrylate-butadiene copolymer; vinyl acetate polymer latexes such as polyvinyl acetate, vinyl acetate-maleate copolymer, vinyl acetate-acrylate copolymer and ethylene-vinyl acetate copolymer; latexes of acrylic polymers or copolymers such as acrylate polymers, methacrylate polymers, ethylene-acrylate copolymer and styrene-acrylate copolymer; vinylidene chloride copolymer latexes; functional group-modified polymer latexes obtained by modifying the above various polymers with monomers containing functional group such as carboxyl group; aqueous adhesives of thermosetting synthetic resins such as melamine resin and urea resin; and synthetic resin adhesives such as polymethyl methacrylate, polyurethane resin, unsaturated polyester resin, vinyl chloride-vinyl acetate copolymer, polyvinyl butyral and alkyd resin. These may be used each alone or in combination. The amount of these polymers is suitably in the range of 2 to 100 parts by weight, preferably in the range of 5 to 30 parts by weight based on 100 parts by weight of solid content of the non-spherical colloidal silica which is cation-modified depending on the purposes.

The ink-receiving layer in the present invention may contain various surfactants for improving the sharpness of images. These surfactants may be any of anionic type, cationic type, nonionic type and betaine type; they may be of a low molecular weight or of a high molecular weight. These may be used each alone or in combination of two or more. Preferred examples of these surfactants are anionic surfactants such as long-chain alkylbenzene-sulfonate salts and long-chain, preferably branched-chain alkylsulfosuccinate esters, nonionic surfactants such as polyalkylene oxide ethers of long-chain, preferably branched-chain alkyl group-containing phenols and polyalkylene oxide ethers of long-chain alkyl alcohols, and fluorinated surfactants as described in Japanese Patent Kokoku No. 47-9303 and U.S. Pat. No. 3,589,906. The amount of the surfactant added to the ink-receiving layer is preferably 0.1 to 7% by weight, more preferably 0.5 to 3% by weight based on the dry solid weight of the ink-receiving layer.

The ink-receiving layer in the present invention may further contain various additives in addition to the cation-modified non-spherical colloidal silica and the optional polymers and surfactants. Examples of these additives are silane coupling agents such as $\gamma$-aminopropyltriethoxysilane and N-$\beta$ (aminoethyl) $\gamma$-aminopropyltrimethoxysilane; hardeners for the polymers such as active halogen compounds, vinylsulfone compounds, aziridine compounds, epoxy compounds, acryloyl compounds and isocyanate compounds; preservatives such as p-hydroxybenzoate ester compounds, benzisothiazolone compounds and isothiazolone compounds mentioned or exemplified in Japanese Patent Kokai (Laid-Open) No. 1-102551; coloring pigments, coloring dyes and fluorescent brighteners mentioned or exemplified in Japanese Patent Kokai (Laid-Open) Nos. 63-204251 and 1-266537; yellowing inhibitors such as sodium hydroxymethanesulfonate and sodium p-toluenesulfinate; ultraviolet absorbers such as benzotriazole compounds having a hydroxy-di-alkylphenyl group at 2-position; antioxidants such as polyhindered phenol compounds as mentioned or exemplified in Japanese Patent Kokai (Laid-Open) No. 1-105245; pencil writing agents such as organic or inorganic fine particles of 0.2–5 $\mu$m in particle size such as starch particles, barium sulfate and silicon dioxide; organopolysiloxane compounds mentioned or exemplified in Japanese Patent Kokoku No. 4-1337; pH regulators such as sodium hydroxide, sodium carbonate, sulfuric acid, hydrochloric acid, phosphoric acid and citric acid; and antifoamers such as octyl alcohol and silicone based antifoamers. These may be used in optional combination.

The means to be used for coating the coating solution for the ink-receiving layer in the present invention include air knife coater, roll coater, bar coater, wire bar coater, blade coater, slide hopper coater, curtain coater, gravure coater, flexogravure coater and combinations thereof. Desirably, the surface of the support is subjected to a surface activation treatment such as corona discharge and flame treatment before coating. As the apparatuses used for drying the coat, mention may be made of hot-air drying machines such as linear tunnel dryer, arch dryer, air-loop dryer and sine curve air float dryer and drying machines such as infrared ray dryer, heating dryer and microwave dryer.

The ink-receiving layer in the present invention may be single-layered or multi-layered. Examples of the multi-layer structure are those mentioned in Japanese Patent Kokai Nos. 57-89954, 60-224578 and 61-12388. For example, the ink permeable layer disclosed in Japanese Patent Kokai No. 61-12388 may be additionally provided on the ink-receiving layer of the present invention. The ink-receiving layer is provided on at least one side of the support, but may be provided on both sides for prevention of curling or for ink jet recording on the both sides.

The support used in the present invention may be either transparent or opaque. As the transparent support, anyone known in the prior arts may be used. Examples of such supports are films or sheets of polyester resins, diacetate resins, triacetate resins, acrylic resins, polycarbonate resins, polyvinyl chloride resins, polyimide resins, cellophane and celluloid, and glass sheets. Thickness of such transparent support is preferably about 10 to 200 μm.

As the opaque support, there may be used anyone known in the prior art such as paper, coated paper, synthetic paper, resin-coated paper, pigment-containing opaque film and foamed film. From the points of gloss and smoothness, synthetic paper, resin-coated paper and various films are preferred. Resin-coated paper supports comprising a paper as a base coated with a resin having film-forming property on one side or preferably both sides thereof are more preferred from the points of feel or impression of high quality.

As the paper base for the resin-coated paper supports, there may be advantageously used a paper mainly composed of natural pulp (hereinafter referred to as "base paper"), but this may be so-called synthetic papers that are made of synthetic fibers or synthetic resins films and are formed into paper-like sheets.

As the pulp which constitutes the base paper for the resin-coated paper support, it is advantageous to use the properly selected natural pulps as mentioned or exemplified in Japanese Patent Kokai (Laid-Open) Nos. 58-73642, 60-67940, 60-69649 and 61-35442. However, synthetic pulps, synthetic fibers or regenerated pulps may also be optionally used. As the natural pulps, there may be advantageously used wood pulps such as softwood pulp, hardwood pulp and mixed pulps of softwood and hardwood pulps subjected to normal bleaching treatments such as chlorine, hypochlorite and chlorine dioxide bleaching treatments and alkali extraction or alkali treatment and optionally oxidation bleaching treatments with hydrogen peroxide, oxygen and the like or combination of these treatments. The natural pulp may be kraft pulp, sulfite pulp and soda pulp.

Various additives can be contained in the base paper of the resin-coated paper support by adding them at the time of stock preparation. Examples of the additives are sizing agents such as fatty acids or metal salts of fatty acids and alkyl ketene dimer emulsions or epoxidized higher fatty acid amides, alkenyl or alkylsuccinic anhydride emulsions and rosin derivatives as mentioned or exemplified in Japanese Patent Kokoku. No. 62-7534; dry strengthening agents such as anionic, cationic or amphoteric polyacrylamide, polyvinyl alcohol, cationized starch and vegetable galacotomannan; wet strengthening agents such as polyamine-polyamide epichlorohydrin resins; loading materials such as clay, kaolin, calcium carbonate and titanium oxide; fixing agents such as water-soluble aluminum salts such as aluminum chloride and aluminum sulfate; pH controlling agents such as sodium hydroxide, sodium carbonate and sulfuric acid; and color pigments, dyes, and fluorescent brighteners as mentioned or exemplified in Japanese Patent Kokai (Laid-Open) Nos. 63-204251 and 1-266537. These may be used in optional combination.

Furthermore, various water-soluble polymers, antistatic agents and additives may be contained in the base paper for the resin-coated paper supports by spraying, size press, tab size press or the like. The water-soluble polymers include starch polymers, polyvinyl alcohol polymers, gelatin polymers, polyacrylamide polymers and cellulose polymers mentioned or exemplified in Japanese Patent Kokai (Laid-Open) No. 1-266537. The antistatic polymers include alkali metal salts such as sodium chloride and potassium chloride, alkaline earth metal salts such as calcium chloride and barium chloride, colloidal metal oxides such as colloidal silica and organic antistatic agents such as polystyrene-sulfonates. Other additives include emulsions and latexes such as petroleum resin emulsions, ethylenevinyl acetate copolymer and emulsions or latexes of copolymer comprising at least ethylene and acrylic acid (or methacrylic acid) as constituting elements which are mentioned or exemplified in Japanese Patent Kokai (Laid Open) Nos. 55-4027 and 1-180538, pigments such as clay, kaolin, talc, barium sulfate and titanium oxide, pH regulators such as hydrochloric acid, phosphoric acid, citric acid and sodium hydroxide, and the coloring pigments, coloring dyes and fluorescent brighteners as aforementioned. These additives can be advantageously contained in optional combination.

As the base papers for the resin-coated paper supports used preferably in the present invention, there may be used those which have a Beck smoothness of preferably at least 100 seconds, more preferably at least 200 seconds as specified in JIS P8119. In order to prepare the base paper having such smoothness, a greater amount of a short fibered hardwood pulp is generally used in the stock furnish and the stock is beaten to cut longer fibers. More specifically, 42 mesh screen residue of the fiber stock after beating is preferably 20–45% and the freeness preferably 200–350 CSF (Canadian Standard Freeness). To the thus beaten fiber stock, internal additives are added, and the stock slurry is formed into paper having a uniform formation by a conventional method using a Fourdrinier machine, cylinder machine or the like as disclosed in Japanese Patent Kokai Nos. 58-37642, 61-260240 and 61-284762. The resulting paper web is then calendered by a machine calender, super calender or hot calender, whereby a base paper having a Beck smoothness of 100 seconds or more can be obtained. While thickness of the base paper is not specific, its basis weight is preferably 30 to 250 g/m$^2$.

As the resin-coated paper support used preferably in the present invention, effective are those which comprise a base paper coated with a film-forming resin on the side on which the ink-receiving layer is to be provided, and especially preferred are those which comprise a base paper coated with a film-forming resin on both sides thereof. The film-forming resins are preferably thermoplastic resins such as polyolefin resins, polycarbonate resins, polyester resins and polyamide resins. More preferred are polyolefin resins from the point of melt-extrusion coatability and especially preferred are polyethylene resins. Alternatively, the base paper may be coated with an electron beam-curable resin disclosed or exemplified in Japanese Patent Kokoku No. 60-17104.

Examples of the polyolefin resin are homopolymers such as polyethylene, polypropylene, polybutene and polypentene, copolymers of two or more a-olefins such as ethylene-butylene copolymer and mixtures thereof. Polyethylene resins are especially preferred from the points of melt-extrusion coatability and bonding strength with the base paper. The polyethylene resins include, for example, low-density polyethylene, medium-density polyethylene, high-density polyethylene, straight-chained low-density polyethylene, copolymers of ethylene with α-olefins such as propylene and butylene, carboxy-modified polyethylene and mixtures thereof. While physical properties of those polyethylene—e.g. density, melt flow rate (hereinafter referred to as "MFR"), molecular weight and molecular weight distribution, may vary, those having a density of 0.90 to 0.97 g/cm$^3$, and an MFR of 0.1 to 50 g/10 min, preferably 0.3 to 40 g/10 min are advantageously used individually, or in combination in a mixture or in different layers laid on one another.

For applying the resin layer on the base paper for the resin-coated paper support, a so-called melt-extrusion coating method is preferred, where a molten thermoplastic resin composition extruded from a slit die in a form of film is fed onto the running base paper web covering it entirely. Temperature of the molten resin film is preferably 280° to 340° C.; the slit die is preferably a flat die such as T-die, L-die or fish-tail die having the slit opening of 0.1 to 2 mm. Prior to being coated with the resin composition, the base paper surface is preferably activated by a treatment such as corona discharge treatment, flame treatment or the like. As a means to further assure bonding between the base paper and the resin film, blowing an ozone-containing gas onto the molten resin film right before it contacts with the base paper, as mentioned in Japanese Patent Kokoku No. 61-42254, may be advantageously employed. In applying the resin layers on the front and back side of the base paper, a so-called tandem extrusion coating method is preferred, where the resin layers on both sides are applied successively and continuously. The surface of the resin layer on which the ink-receiving layer is to be provided can be finished to a glossy surface, a fine rough surface mentioned in Japanese Patent Kokoku No. 62-19732, or a matte or a silky surface; same on the other side is preferably finished to a dull surface. The thickness of the front and back resin layers is not specifically limited but generally falls within the range of 7 to 100 μm, preferably 10 to 50 μm.

The resin layer of the resin-coated paper support used preferably in the present invention may contain various additives. Examples of them are white pigments such as titanium oxide, zinc oxide, talc and calcium carbonate, fatty acid amides such as stearyl amide and arachidinic amide and metal salts of fatty acids such as zinc stearate, calcium stearate, aluminum stearate, magnesium stearate, zinc palmitate, zinc myristate and calcium palmitate mentioned or exemplified in Japanese Patent Kokoku Nos. 60-3430, 63-11655, 1-38291 and 1-38292 and Japanese Patent Kokai No. 1-105245, various antioxidants such as hindered phenols, hindered amines and phosphorus or sulfur based anti-oxidants, blue pigments and dyes such as cobalt blue, ultramarine, cerulean blue and phthalocyanine blue, and magenta pigments and dyes such as cobalt violet, fast violet and manganese violet mentioned or exemplified in Japanese Patent Kokai No. 1-105245, and fluorescent brighteners and ultraviolet absorbers mentioned or exemplified in Japanese Patent Kokai No. 2-254440. These may be contained in optional combination. These additives are preferably added in a form of a master batch or a compound.

A side of the support opposite to the side on which the ink-receiving layer is to be provided may be applied with a backcoat layer for antistatic and other purposes. That side, if necessary, may be subjected to a surface activation treatment such as corona discharge treatment or flame treatment. The backcoat layer may contain inorganic antistatic agents, organic antistatic agents, hydrophilic binders, latexes, hardeners, pigments, surfactants and others as mentioned or exemplified in Japanese Patent Kokoku Nos. 52-18020, 57-9059, 57-53940 and 58-56859 and Japanese Patent Kokai Nos. 59-214849 and 58-184144. These may be contained in optional combination.

The following examples further explain the present invention.

EXAMPLE 1

A pulp mixture of a hardwood bleached sulfite pulp and a hardwood bleached kraft pulp (1:1) was beaten to a Canadian Standard Freeness (CSF) of 320 ml. Then, to the beaten pulp mixture were added 3 parts by weight of cationized starch, 0.2 part by weight of anionized polyacrylamide, 0.4 part by weight of alkyl ketene dimer emulsion (in terms of ketene dimer content) and 0.4 part by weight of polyaminopolyamide epichlorohydrin based on the 100 parts by weight of the pulp. Therefrom was made a paper having a basis weight of 76 g/m$^2$ in bone dry weight. The resulting wet paper was dried at 110° C. and successively impregnated with 25 g/m$^2$ of an impregnating solution comprising 3 parts by weight of carboxy-modified polyvinyl alcohol, 0.05 part by weight of a fluorescent brightener, 0.002 part by weight of a blue dye, 4 parts by weight of sodium chloride, 0.2 part by weight of citric acid and 93 parts by weight of water. The paper was dried by an air drier whose air temperature was set at 110° C. and further supercalendered under a linear pressure of 90 kg/cm to obtain a base paper for resin-coated paper supports for ink jet recording sheets. The resulting base paper had a Beck smoothness of 200 seconds.

Then, the side opposite to the side on which the ink-receiving layer is to be provided, namely, the back side of the thus obtained base paper was subjected to corona discharge treatment, and thereon was melt-extrusion coated a resin composition comprising 25 parts by weight of a low-density polyethylene resin (density 0.92 g/cm$^3$, MFR=2 g/10 min) and 75 parts by weight of a high-density polyethylene resin (density=0.96 g/cm$^3$, MFR=20 g/10 min) at a thickness of 20 μm and at a resin temperature of 320° C. and at a running speed of the base paper of 140 m/min.

Subsequently, another side (the front side) of the base paper was subjected to a corona discharge treatment and thereon was melt-extrusion coated a resin composition comprising 20 parts by weight of a master batch of titanium dioxide pigment composed of 47.5% by weight of a low-density polyethylene resin (density=0.920 g/cm$^3$, MI=8.5 g/10 min), 50% by weight of an anatase type titanium dioxide pigment surface treated with hydrous aluminum oxide (0.75% by weight as $Al_2O_3$ based on titanium dioxide) and 2.5% by weight of zinc stearate, 65 parts by weight of a low-density polyethylene resin (density=0.920 g/cm$^3$, MI=4.5 g/10 min) and 15 parts by weight of a high-density polyethylene resin (density=0.970 g/cm$^3$, MI=7.0 g/10 min) at a thickness of 20 μm and at a resin temperature of 325° C. and at a running speed of the base paper of 140 m/min. The melt-extrusion coating of the polyethylene resin on the both sides was carried out by so-called tandem method, namely, a successive extrusion coating. The surface of the resin layer containing the titanium dioxide pigment of the resin-coated paper was finished to a mirror surface and that of the resin layer on the back side was finished to a matte surface like a paper.

Thereafter, the resin layer on the back side of the resin-coated paper was subjected to corona discharge treatment and thereon was coated a backcoat composition comprising gelatin:silicon dioxide matting agent (average particle size 2 μm)=3:1 (by dry weight) and additionally an epoxy hardener in an amount of 15% by weight of the gelatin and suitable amounts of a coating aid and an inorganic antistatic agent at a coating amount of 3 g/m$^2$ in terms of gelatin. Thus, a resin-coated paper support for ink jet recording was obtained.

Then, the surface of the resin on the front side of the resin-coated paper support was subjected to corona discharge treatment and thereon was coated a solution for the ink-receiving layer comprising 16.6% by weight of a 5% aqueous solution of polyvinyl alcohol (saponification degree: 98.5 mol % and average polymerization degree: 1700), 1% by weight of a 2% mixed solution of 2-ethylhexyl sulfosuccinate in methanol and water, 4.5% by weight (by dry weight) of one of the following colloidal silicas (A)–(E) or no colloidal silica and the balance of pure water at a coating amount of 10 g/m$^2$ (by dry weight) by a curtain coater and then, the coat was dried.

Colloidal silica (A): Spherical colloidal silica modified with aluminum in an amount of about 1.5% by weight (in terms of $Al_2O_3$) based on silica (in terms of $SiO_2$) (manufactured by Nissan Chemical Industries, Ltd.).

Colloidal silica (B): Spherical colloidal silica comprising spherical colloidal silica as a base which was cation-modified with hydrous aluminum oxide in an amount of 12.5% by weight (in terms of $Al_2O_3$) based on silica (in terms of $SiO_2$) (manufactured by Nissan Chemical Industries, Ltd.).

Colloidal silica (C): Acicular colloidal silica (manufactured by Nissan Chemical Industries, Ltd.).

Colloidal silica (D): Acicular colloidal silica comprising acicular colloidal silica (C) as a base which was cation-modified with hydrous aluminum oxide in an amount of about 6.2% by weight (in terms of $Al_2O_3$) based on silica (in terms of $SiO_2$) (manufactured by Nissan Chemical Industries, Ltd.).

Colloidal silica (E): Acicular colloidal silica comprising acicular colloidal silica (C) as a base which was cation-modified with hydrous aluminum oxide in an amount of about 11.7% by weight (in terms of $Al_2O_3$) based on silica (in terms of $SiO_2$) (manufactured by Nissan Chemical Industries, Ltd.).

Recording of images was carried out on the thus obtained ink jet recording sheets by Desk Writer C (Hewlett Packard Co.) ink jet printer and the following quality tests were conducted. The results are shown in Table 1.

Gloss: Gloss of the image portion and the non-image portion on the ink jet recording sheets was visually evaluated.

Water resistance: After lapse of 30 minutes from the recording of the images on the ink jet recording sheet, the sheet was immersed in water for 1 minute and was taken out and dried. Thereafter, the state of retention of the image and the state of blurring of the image were visually evaluated.

Film formability: After lapse of 24 hours from the recording of the images, state of cracking in the image portion and the non-image portion was visually evaluated by a microscope.

Drying properties: After lapse of 30 minutes from the recording of the images, the image portion was rubbed with a finger and the state of the rubbed portion was visually evaluated.

The results of the above tests are graded by the following criteria.

◎: Excellent with no problems.
○: Good.
Δ: Practically acceptable.
×: Bad.

TABLE 1

| (Note 1) | Sample No. | Kind of colloidal silica in ink-receiving layer | Gloss | Water resistance | Film formability | Drying property |
|---|---|---|---|---|---|---|
| | 1 | No | Δ | x | | x |
| | 2 | (A) | x | x | | Δ |
| | 3 | (B) | Δ | | x | x |
| | 4 | (C) | x | x | ◎ | |
| | 5 | (D) | ◎ | | | |
| | 6 | (E) | | ◎ | | |

Note 1:
"" denotes that the sample is within the scope of the present invention.

It can be seen from the results of Table 1 that the ink jet recording sheets of the present invention which contain cation-modified non-spherical colloidal silica in the ink-receiving layer are excellent in gloss, water resistance, film properties and drying properties.

Oil the other hand, the ink jet recording sheets outside the present invention which contain no colloidal silica in the ink-receiving layer or contain colloidal silica which is cation-modified, but is spherical or non-spherical colloidal silica which is not cation-modified in the ink-receiving layer are inferior in gloss, water resistance, film properties or drying properties.

EXAMPLE 2

Example 1 was repeated except that an acicular colloidal silica comprising the acicular colloidal silica (C) as a base which was cation-modified with hydrous aluminum oxide in an amount as shogun in Table 2 (in terms of $Al_2O_3$) based on silica (in terms of $SiO_2$) or colloidal alumina (AS-100 manufactured by Nissan Chemical Industries, Ltd.) was used in place of the colloidal silica used in Example 1. The results are shown in Table 2.

TABLE 2

| Sample No. | Amount of cation-modifier (% by weight) based on $SiO_2$) | Gloss | Water resistance | Film formability | Drying property |
|---|---|---|---|---|---|
| 7 | 0 | x | x | ◎ | |
| 8 | 1 | Δ | Δ | | |
| 9 | 2.5 | | Δ | | |
| 10 | 6.2 | ◎ | | | |
| 11 | 11.7 | | ◎ | | |
| 12 | 20 | | ◎ | | |
| 13 | 25 | | ◎ | Δ | |
| 14 | 40 | Δ | ◎ | Δ | |
| 15 | Colloidal alumina was added. | | ◎ | x | |

It can be seen from the results of Table 2 that the ink jet recording sheets of the present invention which contain cation-modified non-spherical colloidal silica in the ink-receiving layer are excellent in gloss, water resistance, film properties and drying properties. Furthermore, it can be seen that the coating amount of the hydrous metal oxide which is a cation-modifier for the cation-modified non-spherical colloidal silica used in the present invention is preferably 2.5 to 25% by weight, more preferably 5 to 20% by weight (in terms of anhydrous metal oxide) based on silica (in terms of $SiO_2$) from the point of performance of the ink jet recording sheet.

EXAMPLE 3

An ink jet recording sheet was prepared in the same manner as in preparation of Sample No. 5 in Example 1 except that a transparent polyethylene terephthalate film of 160 g/m$^2$ in basis weight was used as a support in place of the support used in Example 1. As a result, an ink jet recording sheet excellent in gloss, water resistance, film properties and transparency and suitable for OHP was obtained.

As explained above, the present invention provides ink jet recording sheets high in gloss, rapid in drying of ink and superior in water resistance of ink images and film properties. Further provided are ink jet recording sheets having the above-mentioned preferable properties and besides high in transparency.

What is claimed is:

1. An ink jet recording sheet comprising a support and an ink-receiving layer provided on at least one side of the support, wherein said ink-receiving layer contains a cation-modified acicular or fibrous colloidal silica obtained by coating the surface of an acicular or fibrous colloidal silica with a cation-modifier, the coating amount of the cation-modifier being 1 to 30% by weight based on the weight of the acicular or fibrous colloidal silica, and the coating amount of the cation-modified acicular or fibrous colloidal silica contained in the ink-receiving layer being 2 to 100 g/m$^2$.

2. An ink jet recording sheet according to claim 1, wherein the cation-modifier is at least one hydrous metal oxide selected from the group consisting of hydrous aluminum oxide, hydrous zirconium oxide and hydrous tin oxide.

3. An ink jet recording sheet according to claim 1, wherein the support is a resin-coated paper comprising a paper coated with a resin on at least one side thereof.

4. An ink jet recording sheet according to claim 3, wherein the polyolefin resin is a polyethylene resin.

5. An ink jet recording sheet according to claim 3, wherein the resin is a polyolefin resin.

6. An ink jet recording sheet according to claim 1, wherein the support is a transparent polyethylene terephthalate.

* * * * *